US006217384B1

(12) United States Patent
Strasser et al.

(10) Patent No.: US 6,217,384 B1
(45) Date of Patent: Apr. 17, 2001

(54) CONNECTOR FOR A COAXIAL CABLE WITH ANNULARLY CORRUGATED OUTER CABLE CONDUCTOR

(75) Inventors: Norbert Strasser, Rosenheim-Oberwöhr; Franz Xaver Pitschi, Rottach-Egern, both of (DE)

(73) Assignee: Spinner GmbH Elektrotechnische Fabrik, Munich (DE)

( * ) Notice: Subject to any disclaimer, the term of this patent is extended or adjusted under 35 U.S.C. 154(b) by 0 days.

(21) Appl. No.: 09/442,186

(22) Filed: Nov. 16, 1999

(30) Foreign Application Priority Data

Dec. 14, 1998 (DE) ..... 198 57 528

(51) Int. Cl.[7] ..... H01R 9/05
(52) U.S. Cl. ..... 439/583; 439/578
(58) Field of Search ..... 439/583, 584, 439/578, 579, 580, 581, 582; 285/322

(56) References Cited

U.S. PATENT DOCUMENTS

| | | | | |
|---|---|---|---|---|
| 4,046,451 | | 9/1977 | Juds et al. | 439/583 |
| 6,032,358 | * | 5/2000 | Wild | 29/863 |
| 6,036,237 | * | 3/2000 | Sweeney | 285/322 |

* cited by examiner

*Primary Examiner*—Gary F. Paumen
*Assistant Examiner*—Alexander Gilman
(74) *Attorney, Agent, or Firm*—Henry M. Feiereisen; Ursula B. Day

(57) ABSTRACT

A connector assembly for a coaxial cable of a type having an annularly corrugated outer cable conductor, includes a head portion which has a clamping surface for establishing a contact from inside with an end portion of an outer cable conductor. A contact sleeve is fitted over the outer cable conductor and has a plurality of axial slits extending from its head portion proximate end to form a plurality of radially resilient segments. Interacting with the head portion is a clamping member which surrounds the contact sleeve and travels along a clamping path for loading the segments of the contact sleeve in a clamping direction, thereby clamping the end portion of the outer cable conductor against the clamping surface of the head portion. The clamping path of the clamping member is divided by an indexing member into first and second sections, with the first section corresponding to a preassembled state of the connector, and with the second section corresponding to a complete assembly of the connector onto the cable end. The indexing member includes an O ring which seals an annular gap between the head portion and the clamping member, and is received in an annular groove formed in one of the head portion and the clamping member. At the end of the first section of the clamping path, the O ring contacts a confronting end face of the connector head portion, and is clamped between the head portion and the clamping member at the end of the second section of the clamping path.

6 Claims, 4 Drawing Sheets

CONNECTOR FOR A COAXIAL CABLE WITH ANNULARLY CORRUGATED OUTER CABLE CONDUCTOR

CROSS-REFERENCES TO RELATED APPLICATIONS

This application claims the priority of German Patent Application, Serial No. 198 57 528.9, filed Dec. 14, 1998, the subject matter of which is incorporated herein by reference.

BACKGROUND OF THE INVENTION

The present invention relates, in general, to a connector for coaxial cables, and more particularly to a connector for coaxial cables of a type having annularly corrugated outer cable conductor.

U.S. Pat. No. 4,046,451, issued on Sep. 6, 1977, describes a connector assembly for a coaxial cable of a type having an annularly corrugated outer cable conductor, with a connector head which is formed with a beveled clamping surface to engage the inner surface of the end portion of the outer cable conductor. Cooperating with the clamping surface of the connector head is a further clamping surface formed on one end of a contact sleeve for engaging the outer surface of the end portion of the outer cable conductor. The contact sleeve is formed at the same time as a hollow screw and has a plurality of slits extending from the connector head proximal end to form a plurality of resilient segments. Each of the segments terminates in a bead for meshing in the first valley of the outer cable conductor and clamping the outer cable conductor against the clamping surface of the connector head along the end portion extending over the contact sleeve, when the connector assembly is mounted to the coaxial cable.

The necessity to dismantle the connector before attachment to the coaxial cable is disadvantageous for several reasons. For one, components may fall out, get lost or mixed up. Moreover, manipulation of several components is time-consuming and annoying, in particular when carrying out the assembly at exposed sites. There is also a risk that errors occur during assembly. A further drawback is the inevitable friction encountered between the beads at the free ends of the segments of the contact sleeve and the outer cable conductor along the outer surface to be contacted and clamped during threaded engagement of the contact sleeve in the connector head. As the outer cable conductor is normally made of a relatively soft copper alloy, the friction frequently results in a squeezing of material in the circumferential direction, leading to respective bending of the segments of the contact sleeve, or as a result of an increase of the torque to be applied for tightening the components in a false indication that a secure clamping and contacting has been attained when in fact that is not the case.

SUMMARY OF THE INVENTION

It is thus an object of the present invention to provide an improved connector, obviating the afore-stated drawbacks.

In particular, it is an object of the present invention to provide an improved connector which is of short axial length compared to conventional connectors.

According to one aspect of the present invention, these objects, and others which will become apparent hereinafter, are attained in accordance with the present invention by providing a head portion having a recess which includes an inner thread and is bounded by a ring surface for establishing a contact from inside with an end portion of an outer cable conductor, with the recess of the head portion being bounded by a smooth inner section which is defined by an inner diameter; a contact sleeve adapted to fit over the outer cable conductor and having a plurality of axial slits extending from its head portion proximate end to form a plurality of radially resilient segments; a hollow screw adapted to fit over the contact sleeve and to threadably engage in the recess along a clamping path for loading the segments of the contact sleeve in a clamping direction, thereby clamping the end portion of the outer cable conductor against the ring surface in the recess of the head portion, with the hollow screw having a thread and being defined by an outer diameter in an area of the thread, whereby the inner diameter of the smooth inner section of the recess is greater than the outer diameter of the hollow screw in the area of the thread; and by providing an indexing member for dividing the clamping path of the hollow screw into first and second sections, with the first section corresponding to a preassembled state of the connector, and with the second section corresponding to a complete assembly of the connector onto the cable end, whereby the indexing member includes an O ring for sealing an annular gap defined between the head portion and the hollow screw when the connector is fully assembled, whereby the O ring is received in an annular groove of the hollow screw and impacts upon a confronting end face of the head portion when the hollow screw has reached the end of the first section of the clamping path.

In accordance with the present invention, a single O ring is used to assume a dual function, namely to realize a sealing of the gap between the hollow screw and the head portion and to provide a tactile resistance to indicate when the correct preassembly stage of the connector is attained. The provision of a single O ring has many advantages. The hollow screw can be provided with a thread of significantly reduced length so that the overall size of the hollow screw can be decreased and thus the overall size of the head portion and as a result also the overall size of the final connector. As a consequence of the compact construction of the connector, significant amounts of material can be saved and the production time can be lowered. In addition, the installation of the connector is facilitated because the number of turns of the hollow screw until reaching the clamped disposition can be cut roughly in half.

According to another aspect of the present invention, the concepts outlined above are also applicable for a connector with a head portion that interacts with a screw cap, i.e. the indexing member is formed by a single O ring which divides the clamping path of the screw cap into first and second sections, to indicate the preassembled state of the connector and the complete assembly of the connector onto the cable end, respectively, whereby the O ring is received in the annular groove of the head portion to realize a seal between the head portion and the screw cap and is contacted by a confronting end face of the screw cap when the screw cap has reached the end of the first section of the clamping path.

The installation of the connector can be further simplified by providing the hollow screw or screw cap with a radially inwardly projecting shoulder for establishing a stop for a ring collar of the contact sleeve and for so limiting a travel path of the contact sleeve in the preassembled state of the connector that an insertion gap for the end portion of the outer cable conductor is formed between the beveled ring surface of the hollow screw or ring surface of the screw cap, and the segments of the contact sleeve. This configuration prevents the end of the outer cable conductor from pushing the contact sleeve to the contacting ring surface or bottom of the head portion when the preassembled connector is placed over the cable. Thus, the preassembled connector can be properly attached to the cable, without requiring repeated attempts to achieve a proper disposition.

The ring collar which limits the travel path of the contact sleeve during placement of the connector over the cable can be attached, with respect to the axial length of the contact sleeve, such that the inwardly projecting shoulder of the hollow screw or screw cap assumes the stop function so that a separate production step for providing the hollow screw or screw cap with a further shoulder is eliminated Suitably, the shoulder has an annular configuration and is defined by an end face which transmits a clamping force onto confronting ends of the segments of the contact sleeve when the hollow screw or screw cap reaches the end of the second section of the clamping path.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
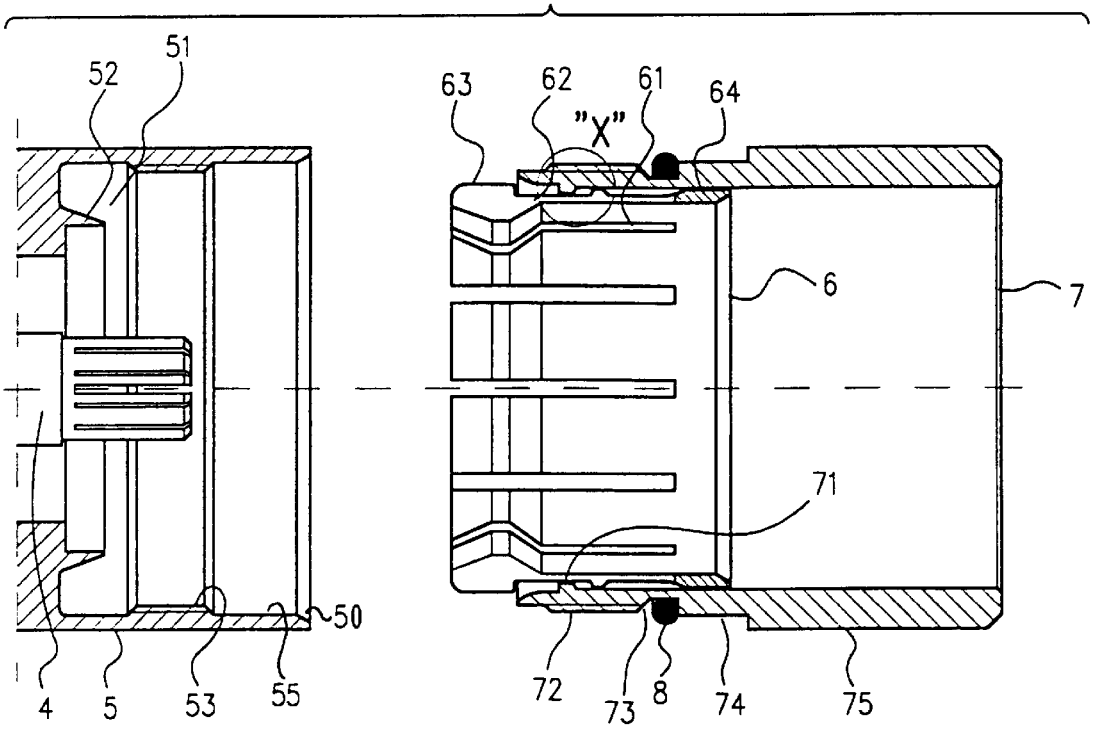
FIG. 1 is a partially exploded sectional view of a first embodiment of a connector according to the present invention, showing individual components of the connector before pre-assembly.

Throughout all the Figures, same or corresponding elements are generally indicated by same reference numerals.

Turning now to the drawing, and in particular to FIG. 1, there is shown a partially exploded sectional view of a first embodiment of a connector according to the present invention for attachment to a connecting end of a coaxial cable. In this context, reference is made to commonly assigned copending patent application, application Ser. No. 09/145,677, entitled "Connector for a Coaxial Cable with Annularly Corrugated Outer Cable Conductor", the disclosure of which is incorporated herein by reference to show one type of connector involved here.

Figure 1A:
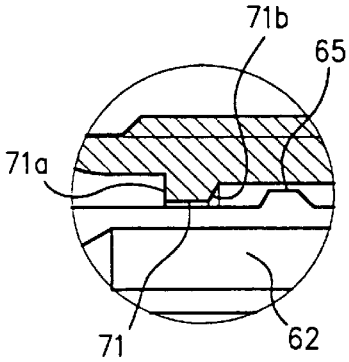
FIG. 1*a* is a cutaway view of the connector of FIG. 1 at an area marked X, showing in detail interacting components between the head portion and the contact sleeve.

The connector includes a connector head 5 which is shown here only by way of its cable-proximal end portion that is of relevance as far as the present invention is concerned The connector head 5 has a chamfered end face 50 and accommodates an inner conductor 4 held centrally in and spaced from the connector head 5 by an insulating plastic disk (not shown). On its cable-proximal end portion, the connector head 5 is formed with a recess 51 which terminates in a clamping surface in the form of a beveled ring surface 52 and includes an internal thread 53. The recess 51 is destined to accommodate a contact sleeve 6 which is configured in the form of a collet. The contact sleeve 6 has a plurality of axial slits 61 extending from the connector head proximal end to form a plurality of resilient segments 62. Each segment 62 has a free end terminating in a bead 63. On its opposite connector head distal end 64, the contact sleeve 6 has a slightly greater outer diameter than in the area of its resilient segments 62. Adjacent the resilient segments 62, the contact sleeve 6 is formed with a ring collar 65 which is interrupted by the slits 61, as best seen in FIG. 1*a*.

The contact sleeve 6 is inserted in a clamping member in the form of a hollow screw 7 by pushing the resilient segments 62 together. In the assembly stage, shown in FIG. 1, the contact sleeve 6 is freely movable within the hollow screw 7 but held captive in the hollow screw 7 through provision of an inwardly projecting annular shoulder 71 which is formed adjacent the connector head proximal end of the hollow screw 7. As shown in particular in FIG. 1*a*, the shoulder 71 has opposite ring-shaped sides 71*a*, 71*b*, with the side 71*a* confronting the connector head 5 and interacting with a complementary confronting surface 63*a* of the beads 63 at the ends of the segments 62. The other side 71*b* of the shoulder 71 interacts with the ring collar 65 of the contact sleeve 6, thereby limiting a displacement of the contact sleeve 6 in the direction of the connector head 5.

The hollow screw 7 has a screw head 75 and is further provided with an external thread 72 which ends in an annular groove 73 for receiving a O ring 8. The groove 73 is followed in the direction toward the screw head 75 by a smooth section 74 of a diameter which is slightly smaller than the inner diameter of the recess 51 along a smooth inner section 55 which is disposed adjacent the internal thread 53 in the recess 51 of the connector head 5.

Figure 2:
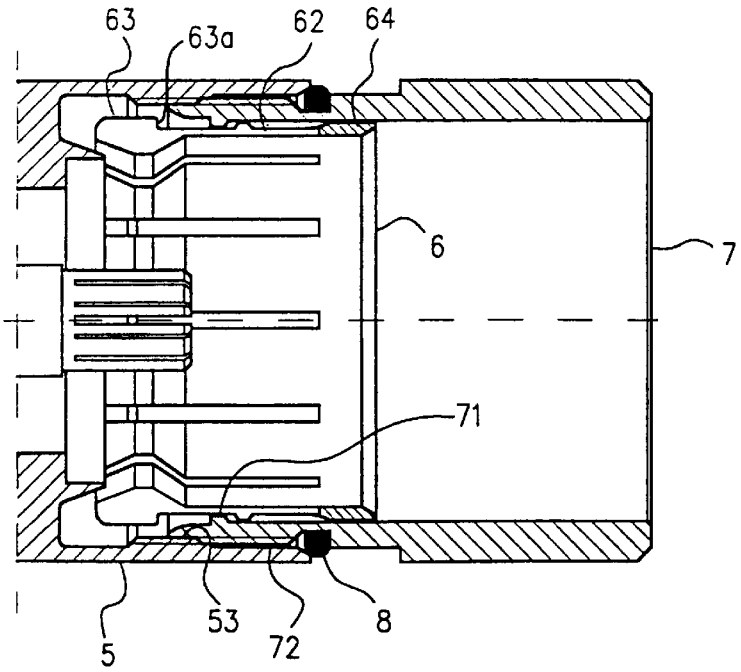
FIG. 2 is a sectional view of the connector of FIG. 1 in the pre-assembled stage.

Turning now to FIG. 2, there is shown a sectional view of the connector of FIG. 1 in a pre-assembled stage, with the hollow screw 7 rotated into the connector head 5 to such an extent that the O ring 8 has reached the chamfered end face 50 of the connector head 5. The initial turns of the outer thread 72 of the hollow screw 7 thereby engage the initial turns of the inner thread 53 of the connector head 5. This position of the hollow screw 7 relative to the connector head 5 marks the end of a first phase of the clamping path of the hollow screw 7 in the connector head 5 and thus the beginning of a second phase of the clamping path, as indicated by a tactile response, i.e. perceivable rise of the torque required fur further threading of the hollow screw 7. This first phase of the clamping path of the hollow screw 7 in the connector head 5 represents the preassembled state of the connector, as supplied by a manufacturer, for attachment to a conventional coaxial cable with annularly corrugated outer cable conductor 3 shown in FIG. 3.

Figure 3:
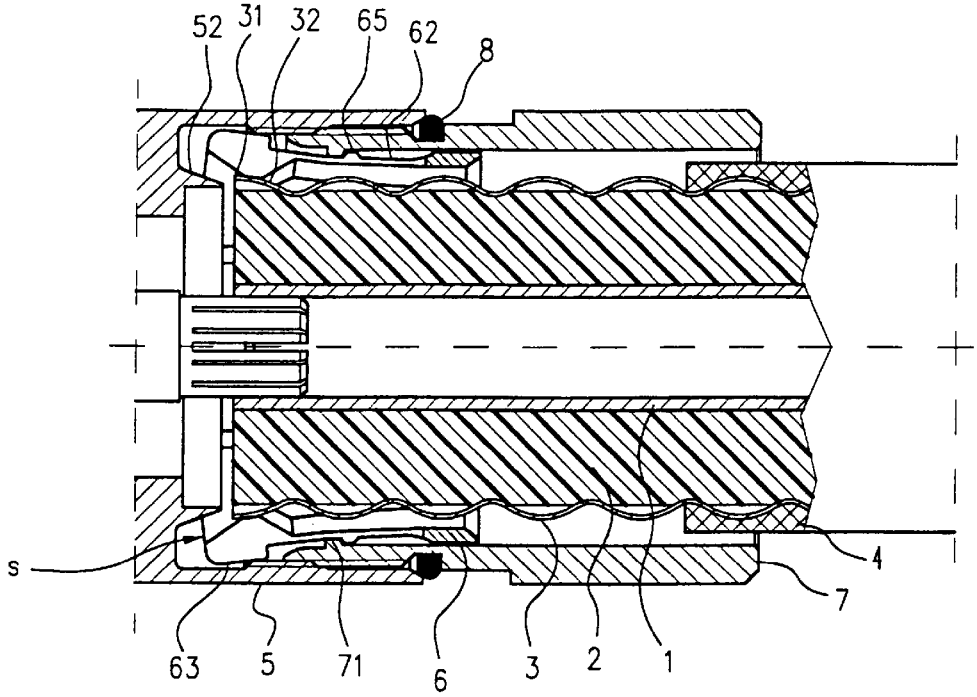
FIG. 3 is a sectional view of the connector of FIG. 1 during a first phase of attachment onto a cable end.
Figure 4:
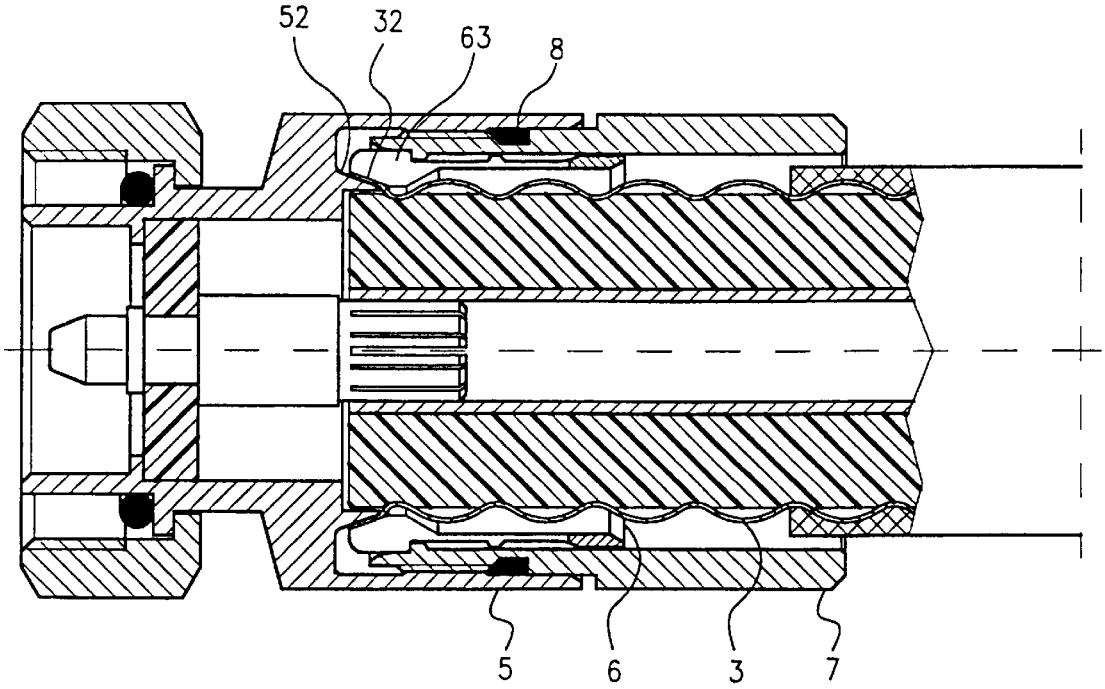
FIG. 4 is a sectional view of the connector of FIG. 1, illustrating the fully assembled connector.

FIG. 3 shows a partial longitudinal section of the preassembled connector for attachment onto a suitably prepared connecting end of the coaxial cable, with the connector not yet occupying its fully assembled disposition. The coaxial cable includes an inner tubular cable conductor 1 which is centered inside the cable and spaced and insulated from the outer cable conductor 3 by a dielectric 2, with the outer surface of the outer cable conductor 3 being covered by a sheath 4. Persons skilled in the art will appreciate that the connection of the inner conductor does not form part of the present invention and thus has been omitted from the drawings for the sake of simplicity. The connector is placed over the confronting end of the coaxial cable until the end 31 of the outer cable conductor 3 has pushed the contact sleeve 6 into the illustrated position in which the ring collar 65 of the contact sleeve 6 rests against the ring shoulder 71 of the hollow screw 7, so that the segments 62 of the contact sleeve 6 are deflected outwards by the cable end 31 of the outer cable conductor 3 and the end portion 32 of the outer cable conductor 3 is disposed in a gaps formed between the beveled ring surface 52 of the connector head 5 and complementary clamping surfaces of the beads 63 at the end of the outwardly deflected resilient segments 62. While the connector head 5 is now held in place, the hollow screw 7 is further threaded into the connector head 5 to cover the second section of its clamping path until the end portion 32 of the outer cable conductor 3 is firmly clamped between the ring surface 52 and the beads 63 of the contact sleeve 6 to thereby effect a secure contacting, as shown in FIG. 4. This now represents the fully assembled stage of the connector.

Figure 5:
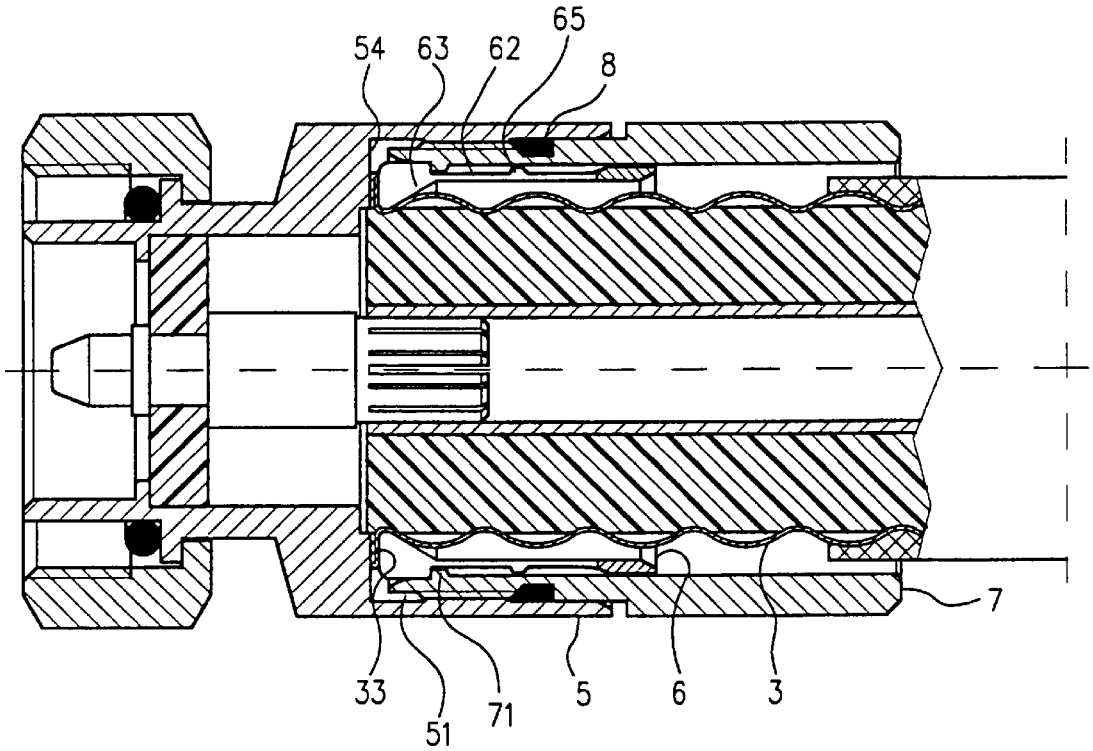
FIG. 5 is a sectional view of a second embodiment of a connector according to the present invention, illustrating the fully assembled connector.

The embodiment described in FIGS. 1 to 4 embodies the invention in a connector that is so designed that the end portion 32 of the outer cable conductor 3 is preferably cut in the area of a corrugation crest and is mechanically clamped and electrically contacted between the beveled ring surface 52 of the connector head 5 and the essentially complementary confronting surfaces of the beads 63 at the ends of the resilient segments 62 of the contact sleeve 6. Persons skilled in the art will understand, however, that the present invention should not be limited to such connectors because the concept of the present invention is equally applicable to connectors which realize the mechanical clamping and electric contacting of the cable and outer cable conductor in a different manner. An example is shown in FIG. 5 which depicts a partially exploded sectional view of a second embodiment of a fully assembled connector according to the present invention. This embodiment of the connector corresponds substantially to the embodiment of FIGS. 1 to 4, with the difference residing primarily in the type of clamping mechanism and type of contact-making mechanism In this context, reference is made to German Pat. No. DE 43 44 328, published Jan. 12, 1995, which illustrates the type of clamping mechanism and type of contact-making mechanism, involved in the embodiment of FIG. 5. Parts corresponding with those in FIG. 1 are denoted by identical reference numerals and not explained again.

The end portion 32 of the outer cable conductor 3 is in contact in the recess 51 with the confronting end face of the connector head 5. In contrast to the embodiment of FIGS. 1 to 4, the recess 51 is not flanked by a beveled ring surface but is bounded by a ring surface 54 which extends substantially in a radial plane, with the flanged end portion 33 of the outer cable conductor 3 being clamped against the ring surface 54. The flanged end portion 33 is formed automatically during advance of the hollow screw 7 along the second section of its clamping path in the recess 51 of the connector head 5 as a consequence of the configuration of the beads 63 at the ends of the resilient segment 62 of the contact sleeve 6, which beads 63 have end faces also oriented in a radial plane, so that in the preassembly stage of the connector, the beads 63 enter the first corrugation valley of the outer cable conductor 3. In the event, the end 31 of the outer cable conductor 3 is initially located in the area of a corrugation crest, as described in the previous embodiment, the end portion 33 of the outer cable conductor 3 is outwardly deflected in one layer in the form of a flange. If, however, the end 31 of the outer cable conductor 3 is initially located in the area of a corrugation valley, a double-layer, flanged deformation of the end portion 33 of the outer cable conductor 3 is realized, when turning the hollow screw 7 along the second section of the clamping path. Also in this case, the interaction between the ring collar 65 of the contact sleeve 6 and the ring shoulder 71 of the hollow screw 7 provides in the pre-assembly stage the formation of a gap between the contacting ring surface 54 and the confronting surfaces of the beads 63, for receiving the end portion 33 of the outer cable conductor 3.

Figure 6:
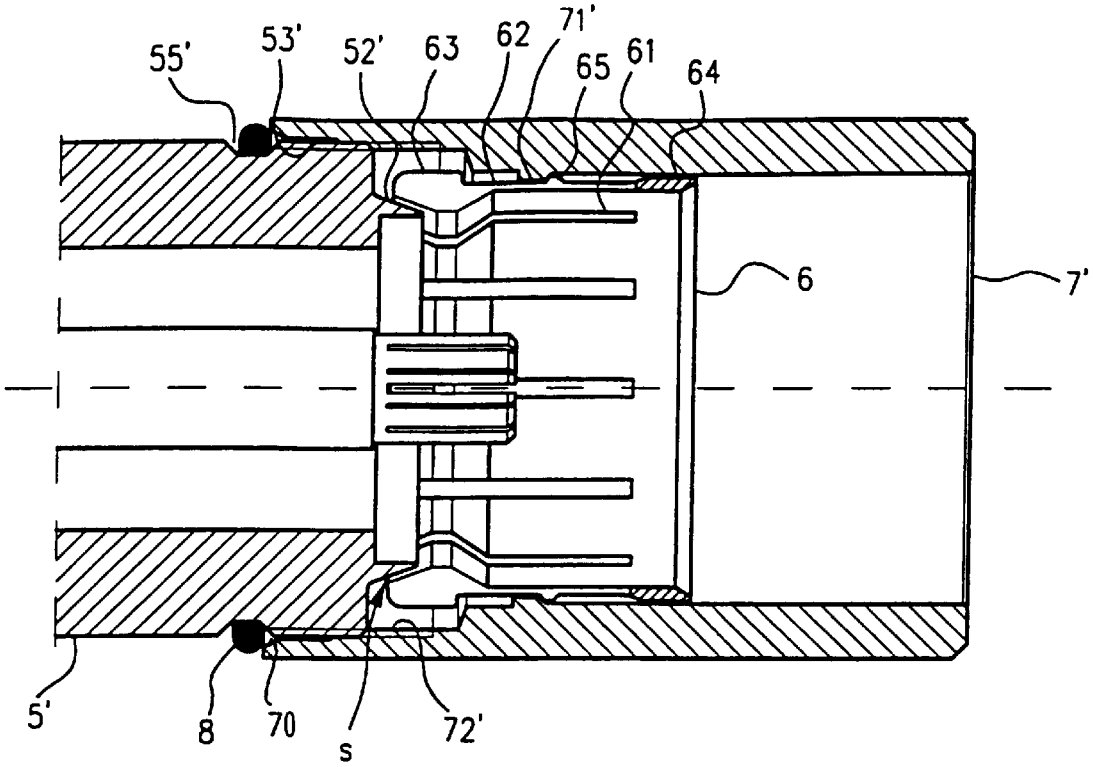
FIG. 6 is a sectional view of a third embodiment of a connector according to the present invention, illustrating the pre-assembled connector.

Turning now to FIG. 6, there is shown a sectional view of a third embodiment of a connector according to the present invention, illustrating the pre-assembled connector. In describing the connector of FIG. 6, like parts will be identified by corresponding reference numerals followed by a "'". In this context, reference is also made to commonly assigned copending patent application, application Ser. No. 09/406,994, entitled "Connector for a Coaxial Cable with Annularly Corrugated Outer Cable Conductor", the disclosure of which is incorporated herein by reference with respect to the illustration of FIGS. 9 and 10 and corresponding description, to thereby show the type of connector involved here.

The connector head 5' has an outer thread 53' which is followed by an annular groove 55' for receiving an O ring 8. At its cable-confronting end face, the connector head 5' has a beveled ring surface 52'. A clamping member in the form of a screw cap 7' includes an internal thread 72' and is so threaded onto the connector head 5' that its head-proximal end face 70' impacts on the O ring 8, thereby indicating the end of the first section of the clamping path. The screw cap 7' has an inwardly projecting annular shoulder 71' and surrounds a contact sleeve 6 which is of identical configuration as the contact sleeve of FIGS. 1 to 4.

Figure 7:
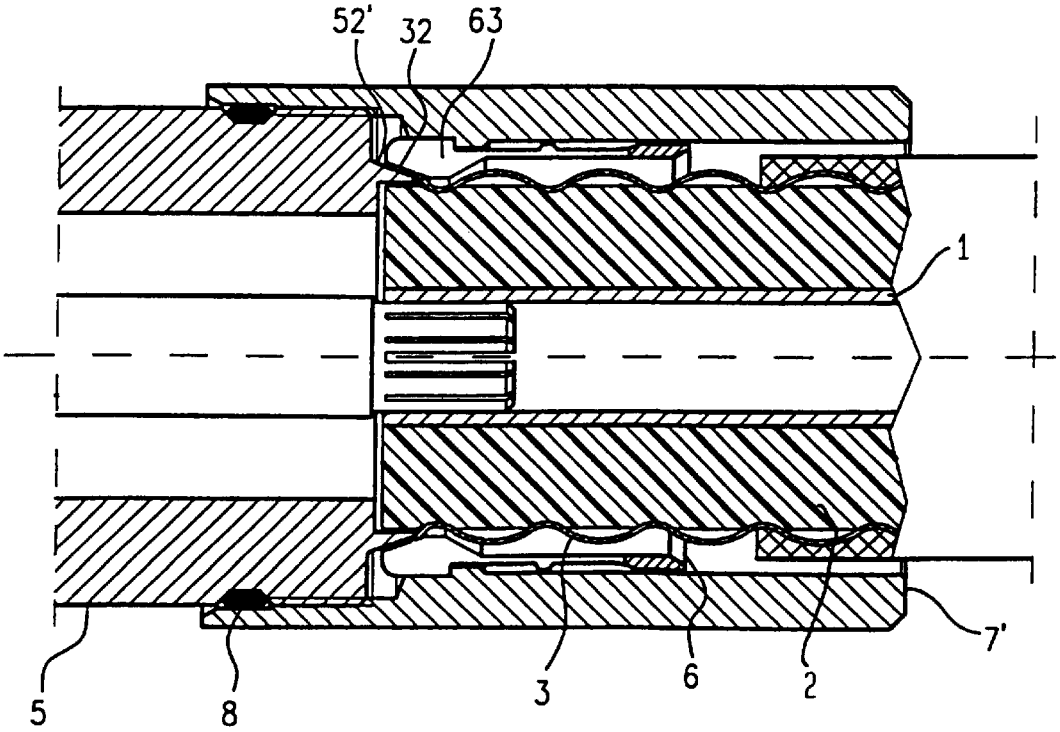
FIG. 7 is a sectional view of the connector of FIG. 6, illustrating the fully assembled connector.

Attachment of the connector onto the coaxial cable is realized in a similar manner as described in connection with the connector of FIGS. 1 to 4. The connector is placed over the confronting end of the coaxial cable until the end 31 of the outer cable conductor 3 has pushed the contact sleeve 6 into a position in which the ring collar 65 of the contact sleeve 6 rests against the annular shoulder 71' of the screw cap 7', so that the segments 62 of the contact sleeve 6 are deflected outwards by the cable end 31 of the outer cable conductor 3 and the end portion 32 of the outer cable conductor 3 is disposed in a gaps formed between the beveled ring surface 52 of the connector head 5 and complementary clamping surfaces of the beads 63 at the end of the outwardly deflected resilient segments 62. While the connector head 5 is now held in place, the screw cap 7 is further threaded into the connector head 5 to cover the second section of its clamping path until the end portion 32 of the outer cable conductor 3 is firmly clamped between the ring surface 52' and the beads 63 of the contact sleeve 6 to thereby effect a secure contacting, as shown in FIG. 7. This now represents the fully assembled stage of the connector.

While the invention has been illustrated and described as embodied in a connector for a coaxial cable with annularly corrugated outer cable conductor, it is not intended to be limited to the details shown since various modifications and structural changes may be made without departing in any way from the spirit of the present invention.

What is claimed as new and desired to be protected by Letters Patent is set forth in the appended claims:

1. A connector assembly for a coaxial cable of a type having an annularly corrugated outer cable conductor, said connector assembly comprising:

a head portion having a recess which includes an internal thread and is provided with a ring surface for establishing a contact from inside with an end portion of an outer cable conductor, said recess of the head portion being bounded by a smooth inner section defined by an inner diameter;

a contact sleeve adapted to fit over the outer cable conductor and having a plurality of axial slits extending inwardly from its head portion proximate end to form a plurality of radially resilient segments; and wherein in the area of the segments the contact sleeve is formed with a ring collar;

a hollow screw adapted to fit over the contact sleeve and to threadably engage the recess along a clamping path for loading the segments of the contact sleeve in a clamping direction, thereby clamping the end portion of the outer cable conductor, which end portion projects beyond an end face of the contact sleeve, against the ring surface in the recess of the head portion, said hollow screw having an inwardly projecting annular shoulder and having a thread and being defined by an outer diameter in an area of the thread, said inner diameter of the smooth inner section of the recess being greater than the outer diameter of the hollow screw in the area of the thread; and an indexing means for dividing the clamping path of the hollow screw into first and second sections, with the first section corresponding to a preassembled state of the connector, and with the second section corresponding to a complete assembly of the connector onto the cable end, said indexing means including an O ring for sealing an annular gap defined between the head portion and the hollow screw when the connector is fully assembled, said O ring being received in an annular groove of the hollow screw and impacting upon a confronting end face of the head portion when the hollow screw has reached the end of the first section of the clamping path and such that one side of the annular shoulder bears against the ring collar for an engagement.

2. The connector assembly of claim 1 wherein the shoulder of the hollow screw has an annular configuration and is defined by an end face which transmits a clamping force onto confronting ends of the segments of the contact sleeve when the hollow screw reaches the end of the second section of the clamping path.

3. A connector assembly for a coaxial cable of a type having an annularly corrugated outer cable conductor, said connector assembly comprising:

a head portion having an external thread and formed with an annular groove adjacent the external thread, said head portion including a beveled ring surface for establishing a contact from inside with an end portion of an outer cable conductor;

a contact sleeve includes a ring collar and is adapted to fit over the outer cable conductor and having a plurality of axial slits extending from its head portion proximate end to form a plurality of radially resilient segments;

a screw cap adapted to fit over the contact sleeve and to threadably engage the head portion along a clamping path for loading the segments of the contact sleeve in a clamping direction, thereby clamping the end portion of the outer cable conductor, which end portion projects beyond an end face of the contact sleeve, against the beveled ring surface of the head portion; and wherein the screw cap having a bore formed with a shoulder which radially projects inwards for establishing a stop for the ring collar for so limiting a travel path of the contact sleeve in a preassembled state of the connector that an insertion gap is formed for the end portion of the outer cable conductor between the beveled ring surface and the segments of the contact sleeve; and an indexing means for dividing the clamping path of the screw cap into first and second sections, with the first section corresponding to a preassembled state of the connector, and with the second section corresponding to a complete assembly of the connector onto the cable end, said indexing means including an O ring received in the annular groove of the head portion and impacted by a confronting end face of the screw cap when the screw cap has reached the end of the first section of the clamping path.

4. The connector assembly of claim 3 wherein the shoulder of the screw cap has an annular configuration and is defined by an end face which transmits a clamping force onto confronting ends of the segments of the contact sleeve when the hollow screw reaches the end of the second section of the clamping path.

5. A connector assembly for a coaxial cable of a type having an annularly corrugated outer cable conductor, said connector assembly comprising:

a head portion having a clamping surface for establishing a contact from inside with an end portion of an outer cable conductor;

a contact sleeve adapted to fit over the outer cable conductor and having a plurality of axial slits extending from its head portion proximate end to form a plurality of radially resilient segments;

a clamping member adapted to threadably engage the head portion by advancing along a clamping path for loading the segments of the contact sleeve in a clamping direction, thereby clamping the end portion of the outer cable conductor against the clamping surface of the head portion; and an indexing means for dividing the clamping path of the clamping member into first and second sections, with the first section corresponding to a preassembled state of the connector, and with the second section corresponding to a complete assembly of the connector onto the cable end, said indexing means including an O ring for sealing an annular gap between the head portion and the clamping member, said O ring being received in an annular groove formed in one of the head portion and the clamping member and contacting a confronting end face of the other one of the head portion and the clamping member when the clamping member has reached the end of the first section of the clamping path; and wherein said contact sleeve includes a ring collar; and wherein said clamping member having a bore formed with a shoulder which radially projects inwards for establishing a stop for the ring collar and for so limiting a travel path of the contact sleeve in a preassembled state of the connector that an insertion gap is formed for the end portion of the outer cable conductor between the clamping surface and the segments of the contact sleeve.

6. The connector assembly of claim 4 wherein the shoulder of the clamping member has an annular configuration and is defined by an end face which transmits a clamping force onto confronting ends of the segments of the contact sleeve when the clamping member reaches the end of the second section of the clamping path.

* * * * *